US007053541B2

(12) United States Patent
Seo et al.

(10) Patent No.: US 7,053,541 B2
(45) Date of Patent: May 30, 2006

(54) RAIL IN FLAT TYPE CATHODE RAY TUBE

(75) Inventors: Bum-Sik Seo, Kyeongsangbuk-Do (KR); Cheol-Ho Choi, Kyeongsangbuk-Do (KR)

(73) Assignee: LG Philips Displays Korea Co., Ltd., Kyeongsangbuk-do (KR)

( * ) Notice: Subject to any disclaimer, the term of this patent is extended or adjusted under 35 U.S.C. 154(b) by 661 days.

(21) Appl. No.: 10/289,422

(22) Filed: Nov. 7, 2002

(65) Prior Publication Data

US 2003/0132694 A1 Jul. 17, 2003

(30) Foreign Application Priority Data

Jan. 17, 2002 (KR) ..... 2002-2749
May 15, 2002 (KR) ..... 2002-26935
Jul. 15, 2002 (KR) ..... 2002-41075

(51) Int. Cl.
*H01J 29/07* (2006.01)
*H01J 29/81* (2006.01)

(52) U.S. Cl. ..... 313/407; 313/402

(58) Field of Classification Search ..... 313/402, 313/407

See application file for complete search history.

(56) References Cited

U.S. PATENT DOCUMENTS

| | | | | | |
|---|---|---|---|---|---|
| 4,686,416 | A | | 8/1987 | Dougherty et al. | |
| 4,695,761 | A | | 9/1987 | Fendley | |
| 4,725,756 | A | | 2/1988 | Kaplan | |
| 4,891,544 | A | * | 1/1990 | Capek et al. | 313/402 |
| 5,025,191 | A | * | 6/1991 | Fendley | 313/407 |
| 5,086,251 | A | * | 2/1992 | Capek et al. | 313/407 |
| 5,090,933 | A | * | 2/1992 | Capek et al. | 445/30 |
| 5,274,302 | A | * | 12/1993 | Capek et al. | 313/407 |
| 6,094,006 | A | | 7/2000 | Park | |

* cited by examiner

*Primary Examiner*—Ashok Patel
*Assistant Examiner*—Mariceli Santiago
(74) *Attorney, Agent, or Firm*—Birch, Stewart, Kolasch & Birch, LLP

(57) ABSTRACT

A rail of a flat type cathode ray tube is disclosed, wherein the flat type cathode ray tube comprises a panel having a deposited fluorescent surface therein and of which interior and exterior surfaces are substantially flat, a funnel connected to the panel; a shadow mask arranged with the inner surface of the panel with a predetermined gap, and a rail fixed to the panel and combined with the shadow mask. In the flat type cathode ray tube, if a height of the rail is L, the rail maintains a predetermined gap of 0.1L~0.3L with the panel and is fixed by a frit glass.

12 Claims, 8 Drawing Sheets

(a=b)

(a'=b')

RAIL IN FLAT TYPE CATHODE RAY TUBE

BACKGROUND OF THE INVENTION

1. Field of the Invention

The present invention relates to a flat type cathode ray tube (CRT), and particularly, to a rail in a flat type cathode ray tube, wherein stress which occurs between a panel and a rail is reduced, thereby preventing cracks in the panel.

2. Description of the Background Art

Generally, cathode ray tube (CRT) is a device to realize a screen by deflecting an electron beam emitted from an electron gun by a deflection yoke, landing on a fluorescent surface formed at an inner surface of a panel by passing through a plurality of electron beam through holes formed on a shadow mask.

Recently, a flat type CRT having a panel of a flat type is developed and commercialized so as to prevent image distortion, to minimize a reflection by exterior light, and to maximize a visible region.

The flat type CRT will be explained with reference to attached drawings.

FIG. 1 is a schematic view showing flat type cathode ray tube (CRT) in accordance with the conventional art, and FIG. 2 is a frontal view showing a panel in a conventional flat type CRT.

As shown in FIG. 1, the conventional flat type CRT comprises a funnel 10 corresponding to a rear glass, a panel 20 corresponding to a frontal glass which is combined to the funnel 10 and sealed to be a high vacuum state. Moreover, an electron gun 40 located at an end portion of the funnel 10 for. emitting an electron beam 50; a deflection yoke 30 mounted at an outer circumference of a neck portion of the funnel 10 for deflecting the electron beam 50 towards a fluorescent surface formed at an inner side of the panel 20, a shadow mask 70 disposed at a rear surface of the panel 20 for sorting out colors of the electron beam 50, and an inner shield 60 prolonged from the panel 20 to the funnel 10 for shielding an external terrestrial magnetism.

Also, a fluorescent film 22 playing a role of luminescent material is deposited in the panel 20, and a rail 80 is attached to the panel to fix the shadow mask 70 and the inner shield 60.

The rail 80, as shown in FIG. 2, includes two major side rails 86 and two minor side rails 87, wherein the major and minor side rails 86 and 87 have different lengths and a same shape, and end portions thereof are cut with 45° respectively and engaged to each other with forming a corner portion 88.

At this time, the corner portion 88 is grinded with a predetermined curvature so as to prevent stress from being concentrated.

The rail 80 is fixed to the panel 20 by a frit glass, wherein one side thereof is formed as a stair shape to fix the shadow mask 70 and the inner shield 60, and the other side thereof is formed as a plane shape to be attached to the panel 20.

A process for attaching the rail 80 to the panel 20 will be explained with reference to FIG. 3.

FIG. 3 is a sectional view showing a process for fixing the rail 80 of the flat type CRT to the panel 20.

First, a frit glass 90 is deposited on a panel fusion portion 84 of the rail 80 in a furnace of high temperature of 400° C.~500° C.

Then, the rail 80 on which the frit glass 90 is deposited is attached to the panel surface 20, and passes through the furnace of high temperature of 400° C.~500° C. According to this, the rail 80 is attached to the panel 20 by melting of the frit glass 90, thereby completing the attachment.

When the rail 80 is attached to the panel 20 at high temperature by the frit glass 90, the rail 80 and the panel 20 have thermal expansion and contraction through the furnace process. At this time, since the rail 80 and the panel 20 have different coefficients of thermal expansion and contraction, remained thermal stress exists by the difference. According to this, cracks occur in the panel 20 due to the thermal stress, thereby damaging the panel 20.

A distribution of the thermal stress occurring at the panel 20 will be explained with reference to the attached drawings.

FIG. 4 is a graph showing a change of stress existing on the panel to which the rail in the conventional flat type CRT is attached according to a location change from a center of the panel to a center of the minor side rail 87.

As shown in FIG. 4, stress is increased towards an outer side of the minor side rails (X axis) from a center portion (point O) of the panel 20, and tensile stress and compression stress are crossed at the fusion portion on which the rail 80 and the panel 20 are fixed.

At this time, cracks occur at the fusion portion due to unbalance of the stress, and the stress unbalance phenomenon severely occurs at the corner portion 88 of the rail 80.

The said phenomenon is resulted from the different thermal expansion ratio between the rail 80 and the panel 20, resulted from that the rail 80 is in contact with the panel 20 to cause the stress unbalance severely, or resulted from that the frit glass 90 for buffering the stress is not sufficiently inserted between the rail 80 and the panel 20.

In the meantime, as another example of the conventional flat type CRT, a receiving groove 102 for receiving the frit glass 90 is formed in the rail 80 so as to buffer the stress occurring by the different thermal expansion ratio between the rail 80 and the panel 20 more efficiently by sufficiently disposing the frit glass 90 between the rail 80 and the panel 20.

That is, as shown in FIGS. 5A and 5B, the receiving groove 102 for receiving the frit glass 90 is formed with a half circle or a square sectional shape in a longitudinal direction of the rail 100.

Accordingly, the stress is buffered more efficiently by disposing the frit glass 90 in the receiving groove 102, and the stress due to the different thermal expansion ratio between the rail 100 and the panel 20 is more reduced by reducing a contacted area between the rail 100 and the panel 20.

However, as shown in FIG. 6, since the receiving groove 102 is formed, in case of that the corner portion 88 of the rail, that is, a portion where the major side rail 86 and the minor side rail 87 are engaged, has a grinding with a predetermined curvature, the receiving groove 102 is opened towards an outer side of the corner portion 88, so that the frit glass 90 is leaked to the opened portion of the corner portion 88 and the leaked frit glass 90 causes thermal stress to be concentrated at the corner portion 88, thereby causing cracks in the panel 20.

SUMMARY OF THE INVENTION

Therefore, an object of the present invention is to provide a flat type CRT, wherein a rail maintains a predetermined gap with a panel and fixed by a frit glass, so that stress which occurs due to thermal expansion ratio between the rail and the panel is buffered by the frit glass, thereby preventing the panel from being cracked by the stress.

To achieve these and other advantages and in accordance with the purpose of the present invention, as embodied and broadly described herein, there is provided a flat type CRT, wherein in case of that a receiving groove is formed in a longitudinal direction of a rail, at least one of an inner leg and an outer leg which are divided as inner and outer sides of the panel by the receiving groove maintains a predetermined gap with the panel, and the legs and the panel are fixed by a frit glass, thereby preventing the panel from being cracked by buffering of the frit glass.

In the flat type CRT of the present invention comprising a panel having a deposited fluorescent surface therein and of which inner and outer surfaces are substantially flat, a funnel connected to the panel, a shadow mask arranged with a predetermined gap from the fluorescent surface of the panel for sorting out colors, and a rail fixed to the panel and combined with the shadow mask, the rail maintains a predetermined gap with the panel to be fixed by a frit glass.

Also, in the flat type CRT of the present invention, the rail includes a receiving groove formed therein towards a length direction thereof for inserting the frit glass, an outer leg formed towards an outer direction of the panel by being divided by the receiving groove, and an inner leg formed at an opposite side of the outer leg, wherein at least one of the outer leg and the inner leg is fixed to the panel with a predetermined gap.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
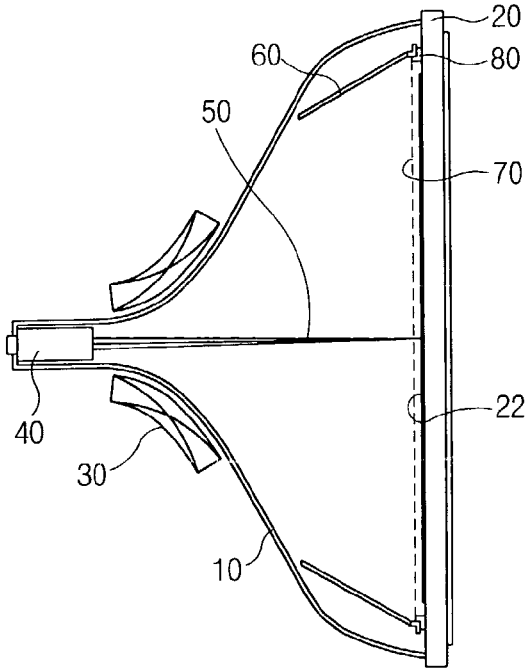
FIG.1 CONVENTIONAL ART
FIG. 1 is a schematic view showing flat type cathode ray tube (CRT) in accordance with the conventional art.
Figure 2:
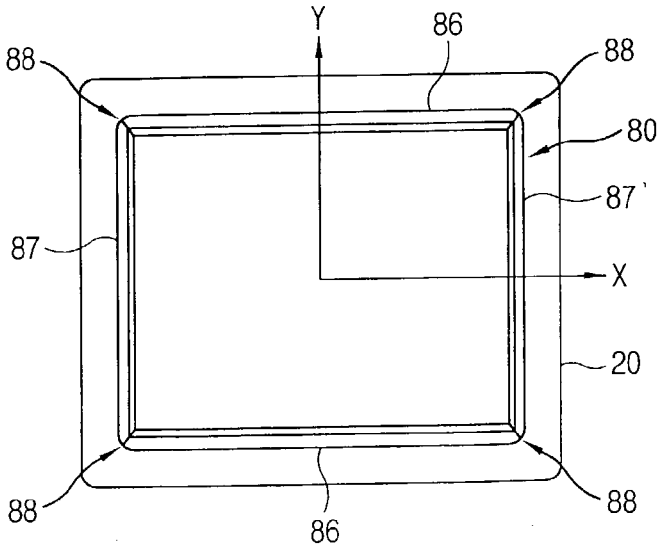
FIG.2 CONVENTIONAL ART
FIG. 2 is a frontal view showing a panel of a conventional flat type CRT.
Figure 3:
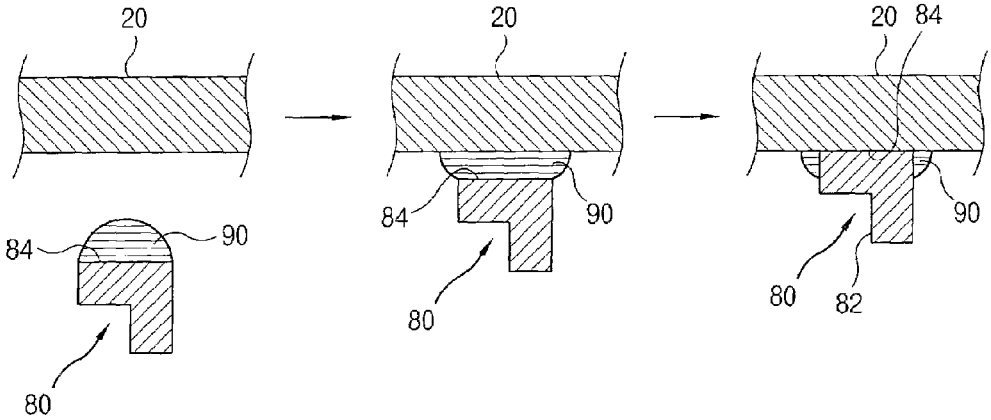
FIG.3 CONVENTIONAL ART
FIG. 3 is a sectional view showing a process that a rail in the conventional flat type CRT is fixed to a panel.
Figure 4:
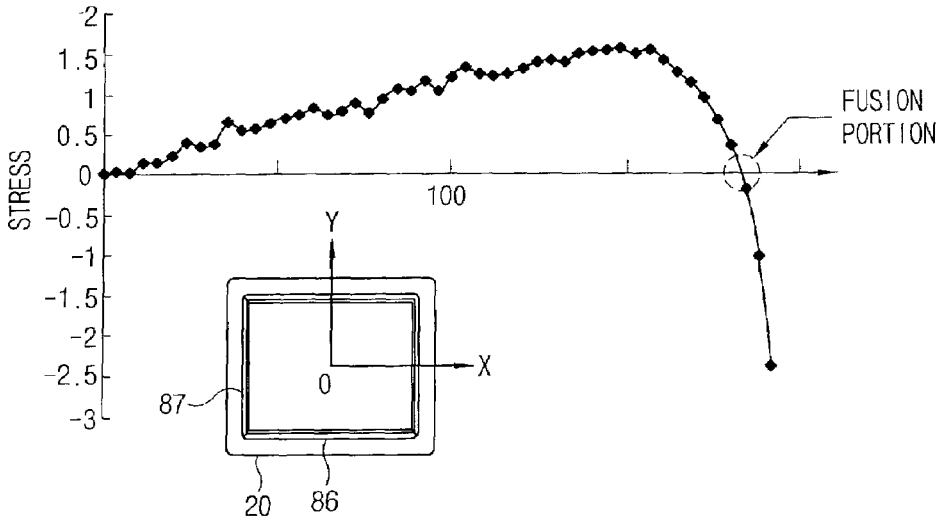
FIG.4 CONVENTIONAL ART
FIG. 4 is a graph showing a change of stress existing on a panel of the conventional flat type CRT according to a location change from a center of the panel to a center of a minor side rail.
Figure 5A:
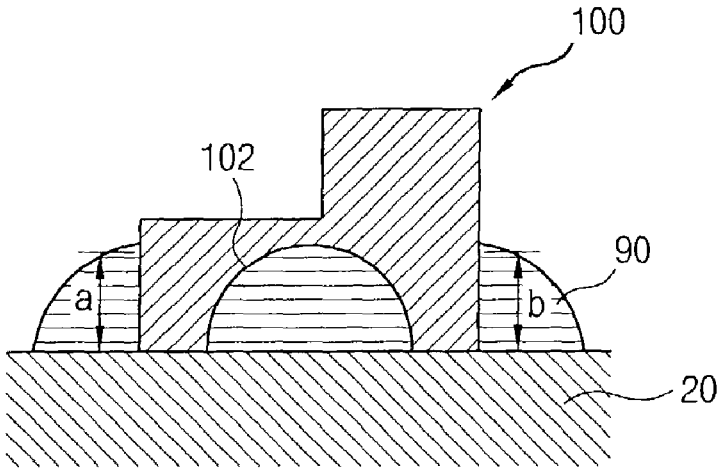
FIG.5A CONVENTIONAL ART
FIGS. 5A and 5B are sectional views showing one embodiment of a rail in the conventional flat type CRT.
Figure 5B:
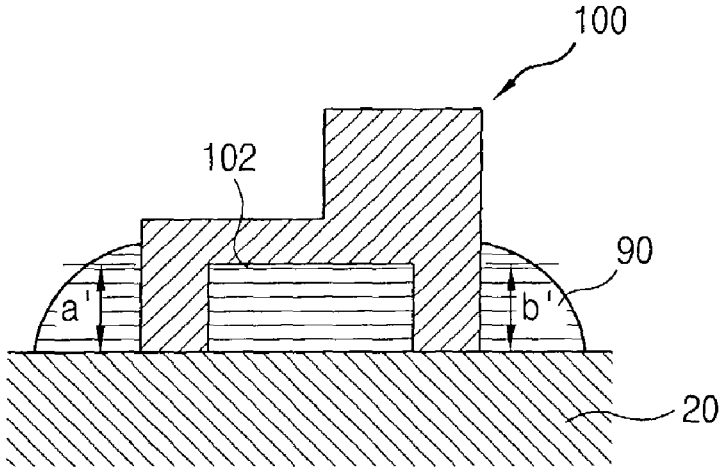
FIG.5B CONVENTIONAL ART
Figure 6:
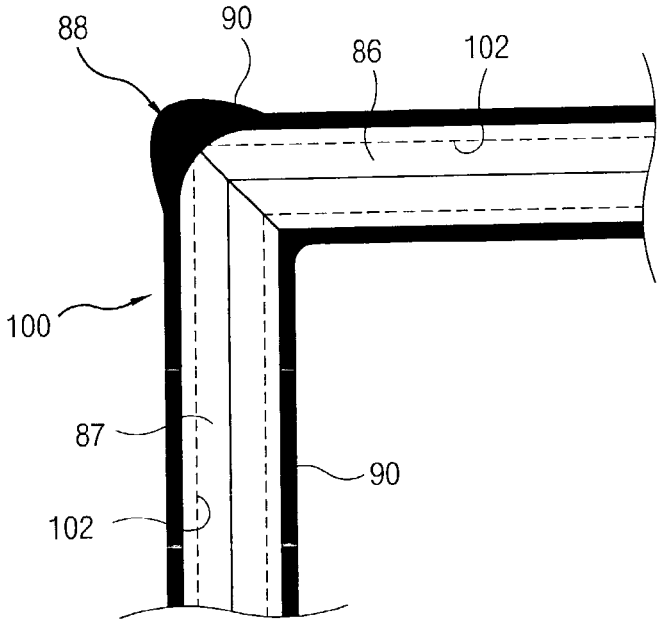
FIG. 6 is a partial frontal view showing a state that a frit glass is leaked at a corner portion where rails of the conventional flat type CRT are respectively engaged.
Figure 7:
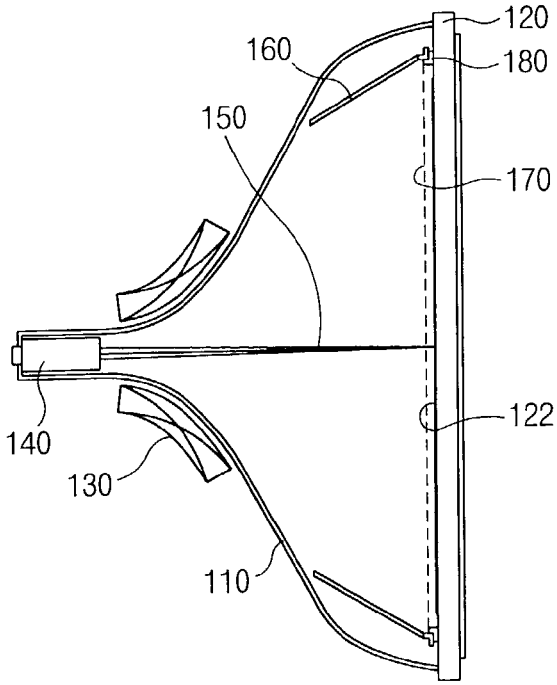
FIG. 7 is a schematic view showing a flat type CRT of the present invention.

Reference will now be made in detail to the preferred embodiments of the present invention, examples of which are illustrated in the accompanying drawings. As shown in FIG. 7, the flat type CRT according to the present invention includes a funnel 110 corresponding to a rear glass and a panel 120 corresponding to a frontal glass which is combined with the funnel 110 and sealed to be a high vacuum state, an electron gun 140 located at an end portion of the funnel 110 for emitting an electron beam 150; a deflection yoke 130 mounted at an outer circumference of a neck portion of the funnel 110 for deflecting the electron beam 150 towards a fluorescent surface of inside of the panel 120, a shadow mask 170 located at a rear surface of the panel 120, and an inner shield 160 prolonged from the panel 120 to the funnel 110 for shielding an external terrestrial magnetism.

Also, a fluorescent film 122 playing a role of luminescent material is deposited at an inner side of the panel 120 of, and a rail 180 is attached to the panel 120 to fix the shadow mask 170 and the inner shield 160.

Figure 8:
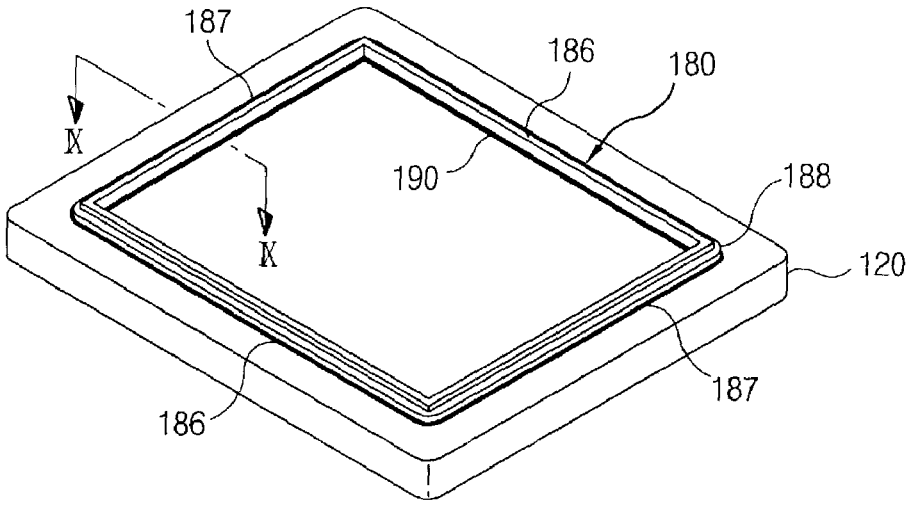
FIG. 8 is a perspective view showing a panel of a flat type CRT according to one embodiment of the present invention.
Figure 9:
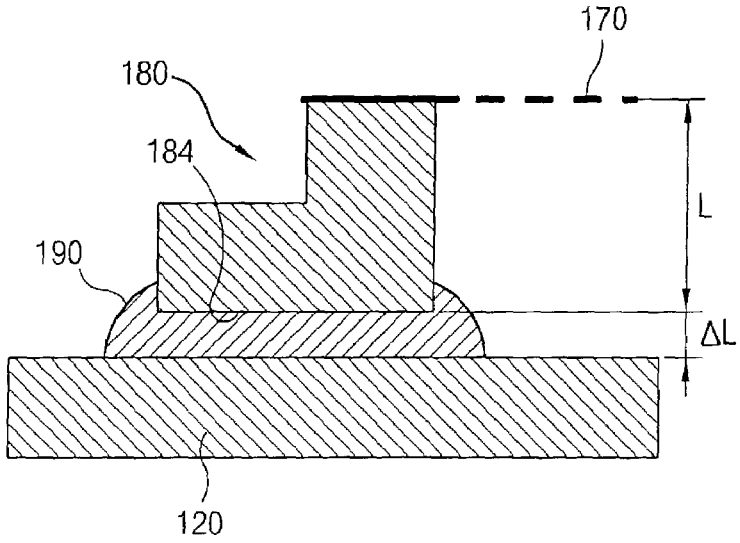
FIG. 9 is a sectional view taken along line IX—IX of FIG. 8.

As shown in FIGS. 8 and 9, one side of the rail 180 is formed as a stair shape to fix the shadow mask 170 and the inner shield 160, and the other side of the rail 180 is formed as a plane shape, so that the rail 180 is fixed to the panel 120 by a frit glass 190 composed of material having a low melting point. The rail 180 includes two major side rails 186 and two minor side rails 187, wherein the major and minor side rails 186 and 187 have different lengths and a same shape, and end portions thereof are cut with 45° respectively and engaged to each other with forming a corner portion 88.

At this time, the corner portion 188 is grinded with a predetermined curvature so as to prevent stress from being concentrated.

The flat type CRT is the same or a similar construction with that of the conventional art.

However, as shown in FIG. 9, the rail 180 according to one embodiment of the present invention is not in contact with the panel 120, but fixed and fixed to the panel 120 by the frit glass 190 with a predetermined gap ($\Delta L$).

That is, since the rail 180 and the panel 120 are composed of different material each other, cracks occur in the panel 120 by the different thermal expansion ratios when the rail 180 and the panel 120 are fixed. To reduce the cracks, the frit glass 190 is disposed between the rail 180 and the panel 120.

Figure 10:
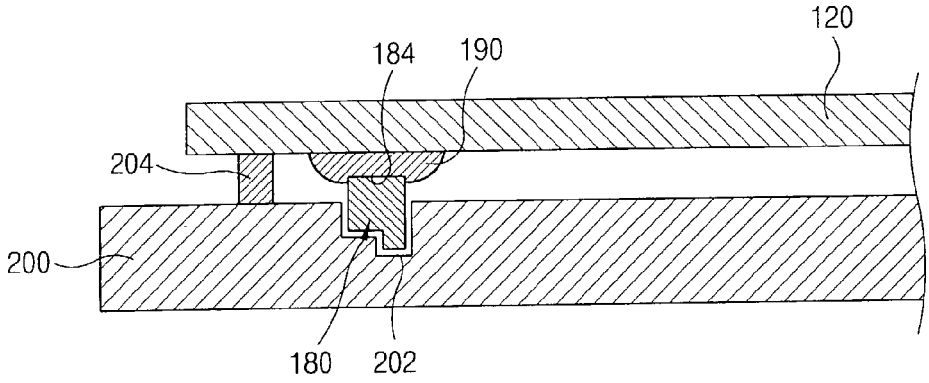
FIG. 10 is a partial frontal view showing a jig for fixing a rail in the flat type CRT to a panel according to one embodiment of the present invention.

At this time, as shown in FIG. 10, a jig 200 is provided to fix the rail 180 to the panel 120 with a predetermined gap.

The jig 200 includes an insertion groove 202 having a shape corresponding to the stair shape of the rail 180 at one side thereof for inserting the rail 180, and a gap settlement member 204 formed at one side of the insertion groove 202 and engaged to the insertion groove for maintaining a gap between the panel 120 and the rail 180.

A processor for fixing the rail of the flat type CRT to the panel according to one embodiment of the present invention will be explained.

First, the rail 180 is inserted to the insertion groove 202 of the stair shape formed at the jig 200, and the frit glass 190 is deposited on the fusion portion 184 of the rail 180 in a furnace of high temperature.

Then, the rail 180 on which the frit glass 190 is deposited is transported towards the panel 120 by a movement of the jig 200, and passes through the furnace of high temperature of 400° C.~500° C., thereby fixing the rail 180 to the panel 120 by melting of the frit glass 190.

At this time, the gap settlement member 204 of the jig 200 maintains a gap between the rail 180 and the panel 120 when the jig 200 is transported towards the panel 120.

Herein, when the gap between the panel 120 and the rail 180 is under 10% of the length (L) of the rail 180, it is difficult to obtain an effect, and when above 30%, a transformation can occur by tensile stress of the shadow mask 170. Accordingly, it is preferable that the rail 180 and the panel 120 maintain a gap corresponding to 10%~30% of a total height (L) of the rail 180. The gap between the panel 120 and the rail 180 is 0.4 mm~1.3 mm when calculated as a real length. In the rail of the flat type CRT according to one embodiment of the present invention, since the rail is not in contact with the panel but fixed by the frit glass by maintaining a predetermined gap, stress due to a difference of the thermal expansion ratio between the rail and the panel can be reduced when compared with the related art in which the rail and the panel are in contact with each other.

Also, thermal stress between the rail and the panel is buffered by the frit glass, so that cracks in the panel by the thermal stress can be prevented.

Also, whereas a rail composed of material having a thermal expansion coefficient similar to the thermal expansion coefficient of the panel as much as possible is used in the related art, in the present invention, the rail can have various selections for material since the cracks by the different thermal expansion ratio can be prevented, and a fabricating cost of the rail can be reduced since the rail can be constructed with a low cost and commercialized material.

That is, in the related art, as material of the rail, expensive material (28% chrome steel) corresponding to 0.97~1.03 times of the thermal expansion coefficient ($105*10^{-7}$ mm/° C.) of the panel is used. However, in the present invention, since cracks in the panel can be prevented, it is possible to use a rail of a low cost and commercialized material corresponding to 1.03~1.15 times of the thermal expansion coefficient ($105*10^{-7}$ mm/° C.) of the panel.

The rail of a flat type CRT according to the present invention will be explained with reference to the attached drawings. Hereinafter, the same components with the one embodiment of the present invention will be endowed the same reference numerals and explanations will be omitted.

Figure 11A:
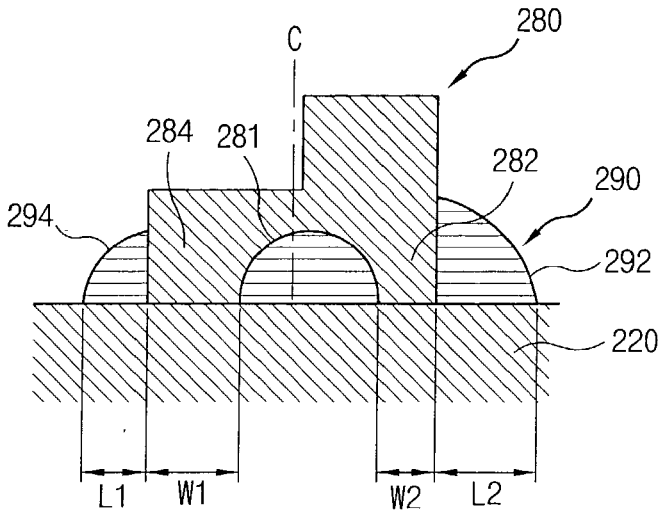
FIG. 11A is a sectional view showing a state that a rail in the flat type CRT is fixed to a panel according to another embodiment of the present invention.
Figure 11B:
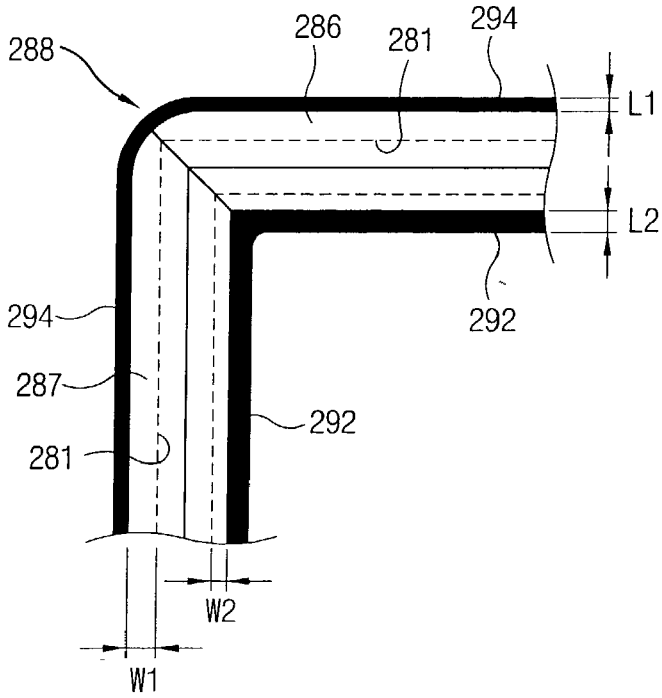
FIG. 11B is a partial plane view showing a state that a rail in the flat type CRT is fixed to a panel according to another embodiment of the present invention.
Figure 12:
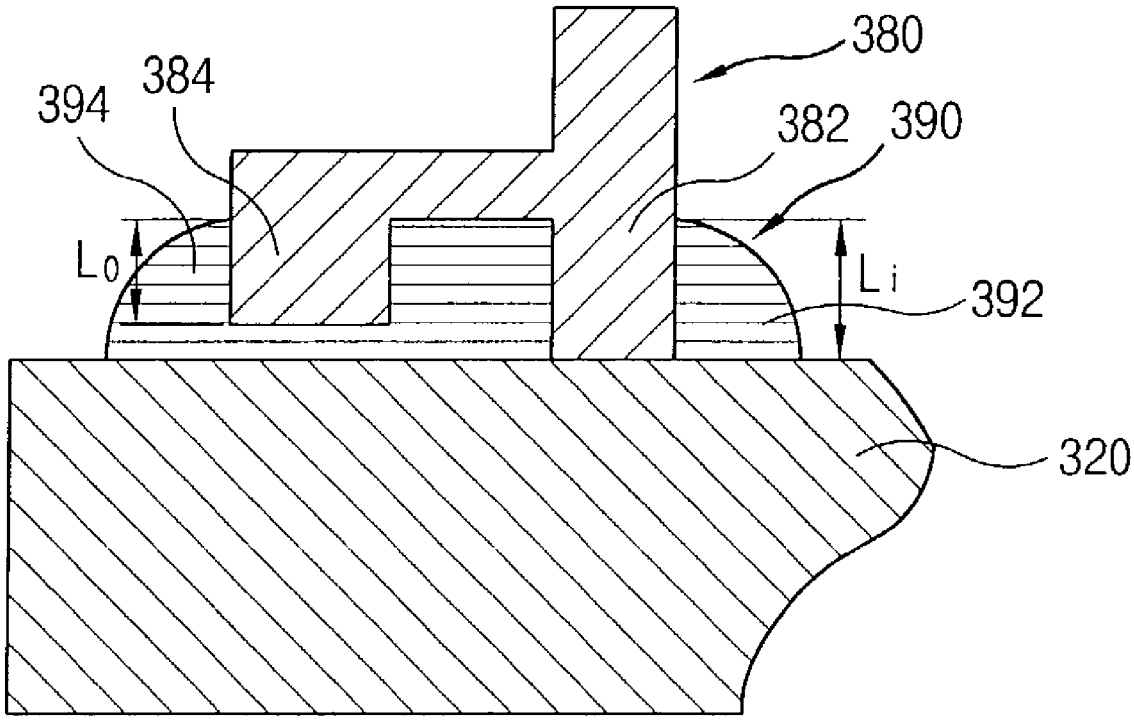
FIG. 12 is a sectional view showing a state that a rail in the flat type CRT is fixed to a panel according to another embodiment of the present invention.

FIGS. 11A and 11B are sectional views showing a rail in a flat type CRT according to another embodiment of the present invention.

That is, as shown in FIGS. 11A and 11B, the rail 280 in the flat type CRT according to another embodiment of the present invention is composed of two major side rails 286 and two minor side rails 287, and provided with a receiving groove 281 for inserting a frit glass 290 as a length direction of the rail 280 at a panel fusion portion where the rail is fixed to the panel 220.

That is, the receiving groove 281 is formed so as to insert the frit glass 290 sufficiently between the rail 280 and the panel 220 to reduce cracks which occur in the panel 220 due to a difference of thermal expansion ratio when the rail 280 is fixed to the panel 220.

The fusion portion where the rail 280 is fixed to the panel is divided by the receiving groove 281 and composed of an outer leg 284 formed towards outside of the panel 220 and an inner leg 282 formed towards inside of the panel. In the meantime, to sufficiently fill the receiving groove 281 in the rail 280 with the frit glass 290, widths of the outer and inner panel fusion portions of the rail 280 have to be reduced. At this time, if a width of the outer leg 284 is too reduced, when the corner portion 288 of the rail 280 is rounded as a predetermined curvature radius (R), the receiving groove 281 is opened outwardly towards the corner portion 288, so that the frit glass 290 is leaked to cause cracks in the panel 220. Therefore, a width of the outer leg 284 has to be set lest the receiving groove 281 should be opened outwardly even if the corner portion 288 of the rail 280 is rounded.

Accordingly, a relationship among the rounding curvature radius (R) of the corner portion 288 of the rail 280, a width of the outer leg (W1), and a width of the inner leg (W2) is preferably set as follows.

$$W1/R \geqq 0.3 \quad (1)$$

$$W2/W1 < 1 \quad (2)$$

That is, in case that a ratio between the curvature radius (R) of the corner portion 288 of the rail 280 and the width of the outer leg 284 (W1) of the panel 220 is under 0.3, the receiving groove 281 is opened towards the corner portion 288, so that the frit glass 290 is leaked to cause cracks in the panel 220.

Also, since the width of the outer leg 284 is set to be large, a hole does not occur at the time of a rounding process of the corner portion 288, and since an area of the receiving groove 281 is set to be wider than that of the related art, the frit glass 290 is more deposited, thereby dispersing the stress and lowering a crack occurrence.

However, in the flat type CRT having the said structures, since the width of the outer leg 284 (W1) is wider than that of the inner leg 282 (W2), when the rail 280 is fixed to the panel 220, the frit glass 290 has a lowered flow towards the outer leg 284 than the inner leg 282. Accordingly, as shown in FIGS. 11A and 11B, a phenomenon that a width of the frit glass 294 (L1) dispersed at an outer side of the rail 280 is reduced than that of the frit glass 290 (L2) dispersed at an inner side of the rail 280 occurs.

Therefore, unbalanced thermal stress occurs by a difference of a dispersed amount between the frit glass 292 at the inner side of the rail 280 and the frit glass 294 at the outer side of the rail 280.

Also, since the width (W2) of the inner leg 282 is narrower than that (W1) of the outer leg 284 of the rail 280, the receiving groove 281 is formed with a bias from a vertical center (C) of the rail 280 to an inner side, thereby increasing the unbalance stress dispersion between the inner side and the outer side of the rail 280.

Since the said unbalanced thermal stress cause cracks, a length (Lo) of the outer leg 384 is formed to be shorter than that (Li) of the inner leg 382, and a space is obtained between the outer leg 384 and the panel 320, thereby increasing a flow of the frit glass 390 towards an outer side direction.

In case that the length (Lo) of the outer leg 384 is formed to be shorter than that (Li) of the inner leg 382, the frit glass 390 flows outwardly in a smooth state and an amount of the frit glass at the inner side 392 and the frit glass at the outer side 394 is formed uniformly, thereby preventing the unbalanced thermal stress which occurs at the inside and outside of the rail 380.

Also, in case that the length (Lo) of the outer leg 384 is formed to be shorter than that (Li) of the inner leg 382, when the rail 380 is attached to the panel 320, the inner leg 382 of the rail 380 is in contact with the panel 320, but the outer leg 384 is not in contact with the panel 320, and the frit glass 390 is inserted therebetween. According to this, thermal stress between the rail 380 and the panel 320 is buffered by the frit glass 390, thereby preventing cracks in the panel 320 due to the thermal stress.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A rail in a flat type cathode ray tube (CRT), the flat type CRT comprising a panel having a fluorescent surface therein and of which inner and outer surfaces are substantially flat; a funnel connected to the panel; a shadow mask arranged with a predetermined gap from the inner surface of the panel; and a rail fixed to the panel and combined with the shadow mask, wherein the rail maintains a predetermined gap of 0.1L~0.3L with the panel and is attached by a frit glass when a height of the rail is L.

2. The rail of flat type CRT of claim 1, wherein a gap between the rail and the panel is supposed to be ΔL, and the ΔL is 0.4~1.3 mm.

3. The rail of the flat type CRT of claim 1, wherein a corresponding side of the rail to the panel is flat.

4. The rail of claim 1, wherein a thermal expansion coefficient of the rail is 1.03~1.15 times of that of the panel.

5. A rail of a flat type CRT including:

a receiving groove formed in the rail as a length direction thereof for inserting a frit glass;

an outer leg formed towards an outer side direction of the panel by being divided by the receiving groove; and an inner leg formed at an opposite side of the outer leg, wherein the rail is fixed by the frit glass and the outer and inner legs have different lengths each other.

6. The rail of claim 5, wherein the following condition is satisfied:

$W1/W2>1$, where W1 denotes a width of the outer leg and W2 denotes a width of the inner leg.

7. The rail of claim 6, wherein the following formula is satisfied:

$Lo/Li<1$, where Lo denotes a length of the outer leg and Li denotes a length of the inner leg.

8. The rail of claim 5, wherein the following condition is satisfied:

$W1/R \geqq 0.3$, where W1 denotes a width of the outer leg and R denotes a curvature radius of a corner portion of the rail.

9. A rail of a flat type CRT comprising:

a receiving groove formed in the rail as a length direction thereof for inserting a frit glass;

an outer leg formed towards an outer side direction of the panel by being divided by the receiving groove; and an inner leg formed at an opposite side of the outer leg, wherein the rail is fixed to the panel by the frit glass, and the following condition is satisfied: $W1/W2>1$, where W1 denotes a width of the outer leg and W2 denotes a width of the inner leg.

10. The rail of claim 9, wherein the following condition is satisfied:

$W1/R \geqq 0.3$, where W1 denotes a width of the outer leg and R denotes a curvature radius of a corner portion of the rail.

11. The rail of claim 9, wherein the outer leg and the inner leg have different lengths each other.

12. The rail of claim 11, wherein the following condition is satisfied: $Lo/Li<1$, where Lo denotes a length of the outer leg and Li denotes a length of the inner leg.

* * * * *